US008142145B2

(12) United States Patent
Thut

(10) Patent No.: US 8,142,145 B2
(45) Date of Patent: Mar. 27, 2012

(54) RISER CLAMP FOR PUMPS FOR PUMPING MOLTEN METAL

(76) Inventor: Bruno H. Thut, Chagrin Falls, OH (US)

( * ) Notice: Subject to any disclaimer, the term of this patent is extended or adjusted under 35 U.S.C. 154(b) by 484 days.

(21) Appl. No.: 12/427,330

(22) Filed: Apr. 21, 2009

(65) Prior Publication Data

US 2010/0266396 A1 Oct. 21, 2010

(51) Int. Cl.
*F03B 1/04* (2006.01)

(52) U.S. Cl. ..... 415/200; 415/115; 415/93; 416/181; 416/241 R

(58) Field of Classification Search ..... 415/93, 415/115, 200, 207, 222; 416/181, 241 R
See application file for complete search history.

(56) References Cited

U.S. PATENT DOCUMENTS

| | | | | |
|---|---|---|---|---|
| 5,203,681 | A | 4/1993 | Cooper | |
| 5,330,328 | A | 7/1994 | Cooper | |
| 5,685,701 | A | 11/1997 | Chandler et al. | |
| 6,086,120 | A | 7/2000 | Deaver | |
| 6,187,096 | B1 | 2/2001 | Thut | |
| 6,562,286 | B1 | 5/2003 | Lehman | |
| 6,857,814 | B2 | 2/2005 | Jensen | |
| 7,185,798 | B2 | 3/2007 | Butler | |
| 7,272,204 | B2 | 9/2007 | Jensen | |
| 7,314,348 | B2 | 1/2008 | Thut | |
| 7,906,068 | B2 * | 3/2011 | Cooper | 266/239 |
| 2006/0198725 | A1 * | 9/2006 | Thut | 415/93 |
| 2008/0107227 | A1 | 5/2008 | Koepke | |
| 2008/0205578 | A1 | 8/2008 | Abura et al. | |
| 2008/0236336 | A1 * | 10/2008 | Thut et al. | 75/392 |

FOREIGN PATENT DOCUMENTS

| | | |
|---|---|---|
| JP | 10186080 | 7/1998 |
| JP | 11264400 | 9/1999 |

* cited by examiner

*Primary Examiner* — David Nhu
(74) *Attorney, Agent, or Firm* — Pearne & Gordon LLP

(57) ABSTRACT

This disclosure features a transfer pump for pumping molten metal having a riser with a reusable socket. The pump includes a motor, support structure above a molten metal bath, a motor driven shaft and an impeller on an end of the shaft rotatable in a base. A riser made of refractory material extends from a transfer opening in the base to the support structure. The riser has a passageway for molten metal along a length of the riser. A clamp has a first clamp portion fixedly connected to the support structure and a second clamp portion that is pivotable with respect to the first clamp portion. A fastener is used to open and close the clamp. Sections of a split socket each have a flange and a body portion. The socket is received in the clamp such that the flanges of the socket are disposed above the clamp, and when the clamp is closed the socket holds the riser.

6 Claims, 4 Drawing Sheets

RISER CLAMP FOR PUMPS FOR PUMPING MOLTEN METAL

TECHNICAL FIELD

The field relates to transfer pumps for molten metal and, in particular, to a device for securing a riser of the pump to a motor mount.

BACKGROUND

Pumps for molten metal can be used to transfer molten metal from one location to another, which are referred to as transfer pumps. Usually, such pumps only transfer molten metal between locations or only circulate molten metal. However, a new design by the assignee can combine functions in a single pump. That is, the same pump can transfer the molten metal between locations or circulate the molten metal around the pump, or can conduct both operations simultaneously. Transfer pumps include a pump base that is submerged in the molten metal and include a riser enabling the molten metal to travel along a passageway of the riser, to an elbow at the motor mount above the molten metal, and then along the piping there to another location.

In the past, pumps have had risers cemented to the base. In addition, the riser has been connected to the motor mount by cementing a socket onto an end of the riser having flanges that are fastened to the motor mount. When the riser of the pump becomes worn, the riser and cemented socket on the end of the riser are often both disposed of.

TECHNICAL SUMMARY

This disclosure features a transfer pump for pumping molten metal having a riser with a reusable socket. A motor has a drive shaft. Support structure is located above a bath of molten metal on which the motor is disposed. A shaft made of refractory material has a first end coupled to the drive shaft and a second end. An impeller made of refractory material is connected to the second end of the shaft. A base made of refractory material has an impeller chamber in which the impeller is rotatably disposed and a transfer opening. An inlet opening leads from an exterior surface of the base into the impeller chamber. A riser made of refractory material extends from the transfer opening to the support structure. The riser has a passageway for molten metal along its length. A clamp has a first clamp portion fixedly connected to the support structure and a second clamp portion that is pivotable with respect to the first clamp portion, and a fastener for opening and closing the clamp. A split socket has a flange and a body portion. The socket is received in the clamp such that the flange of the socket is disposed above the clamp and when the clamp is closed the socket holds the riser.

The riser can abut against the base in fluid communication with the transfer opening without being fastened or cemented to the base.

The support structure can include a plate on which the motor is mounted and a slot in the plate. The first clamp portion is fixedly fastened to the plate in the slot such as by welding.

The riser includes a projection or a recess in its exterior surface. The split socket comprises two or more sections. Each of the socket sections includes an interior surface having a projection or a recess such that the projection of the riser or socket corresponds to the recess of the riser or socket. When the socket is received in the clamp the flanges of the socket are positioned above the clamp. When the clamp is closed the sections of the socket are compressed against the riser such that the projection engages the recess.

A pivot can be located at one end of the clamp portions and one of the clamp portions can comprise a fork at another end of the clamp portions. The fastener includes a swing bolt rotatably fastened to a clamp portion and movable into the fork and a nut which is rotatable on the swing bolt against the fork. An obstruction on the swing bolt can prevent the nut from being removed from the swing bolt.

Many additional features, advantages and a fuller understanding of the invention will be had from the accompanying drawings and the detailed description that follows. It should be understood that the above Technical Summary provides a description in broad terms while the following Detailed Description provides a more narrow description and presents embodiments that should not be construed as necessary limitations of the broad invention as defined in the claims.

DETAILED DESCRIPTION

Figure 1:
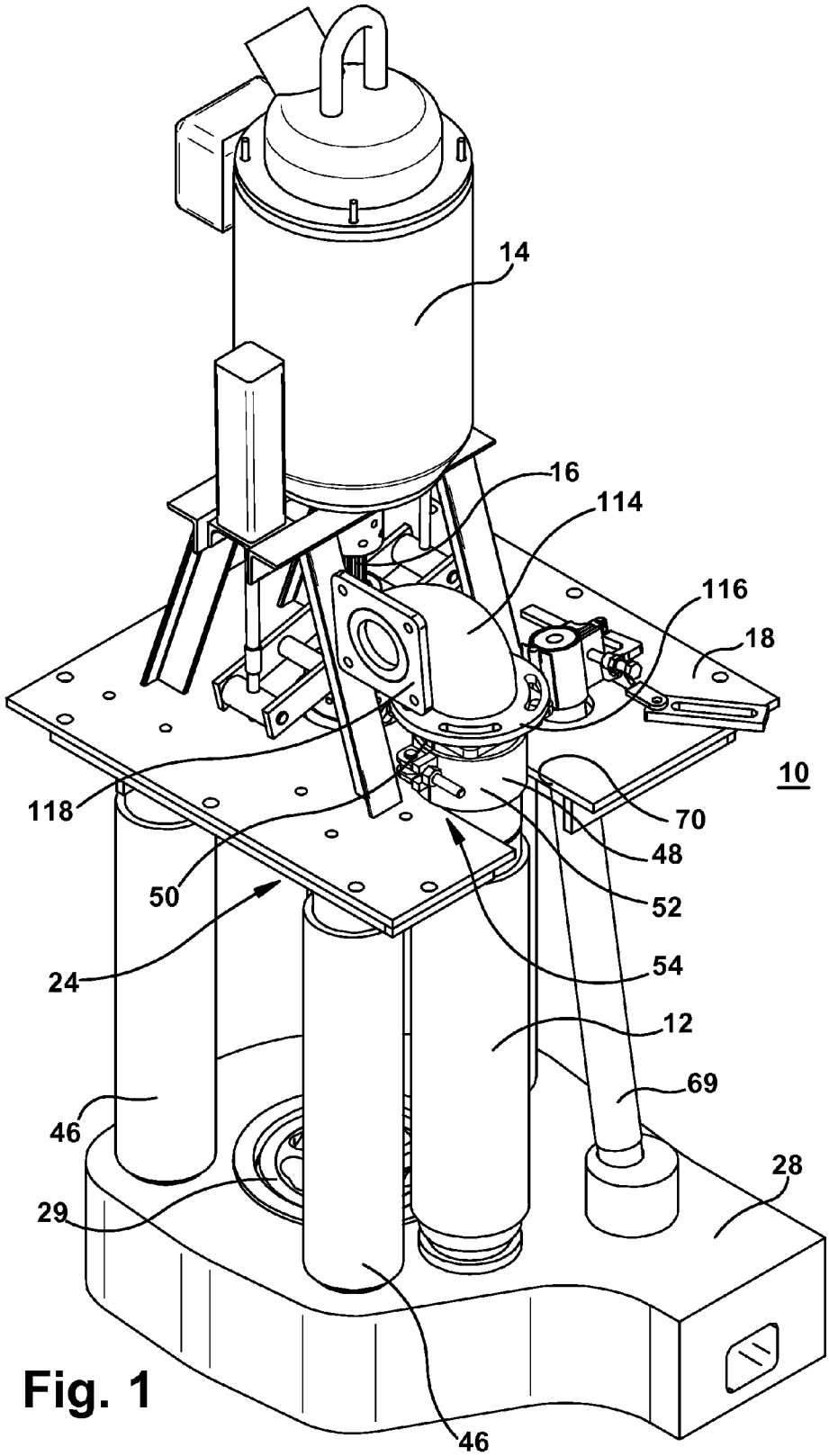
FIG. 1 is a perspective view of a pump for pumping molten metal using a clamp of this disclosure.
Figure 2:
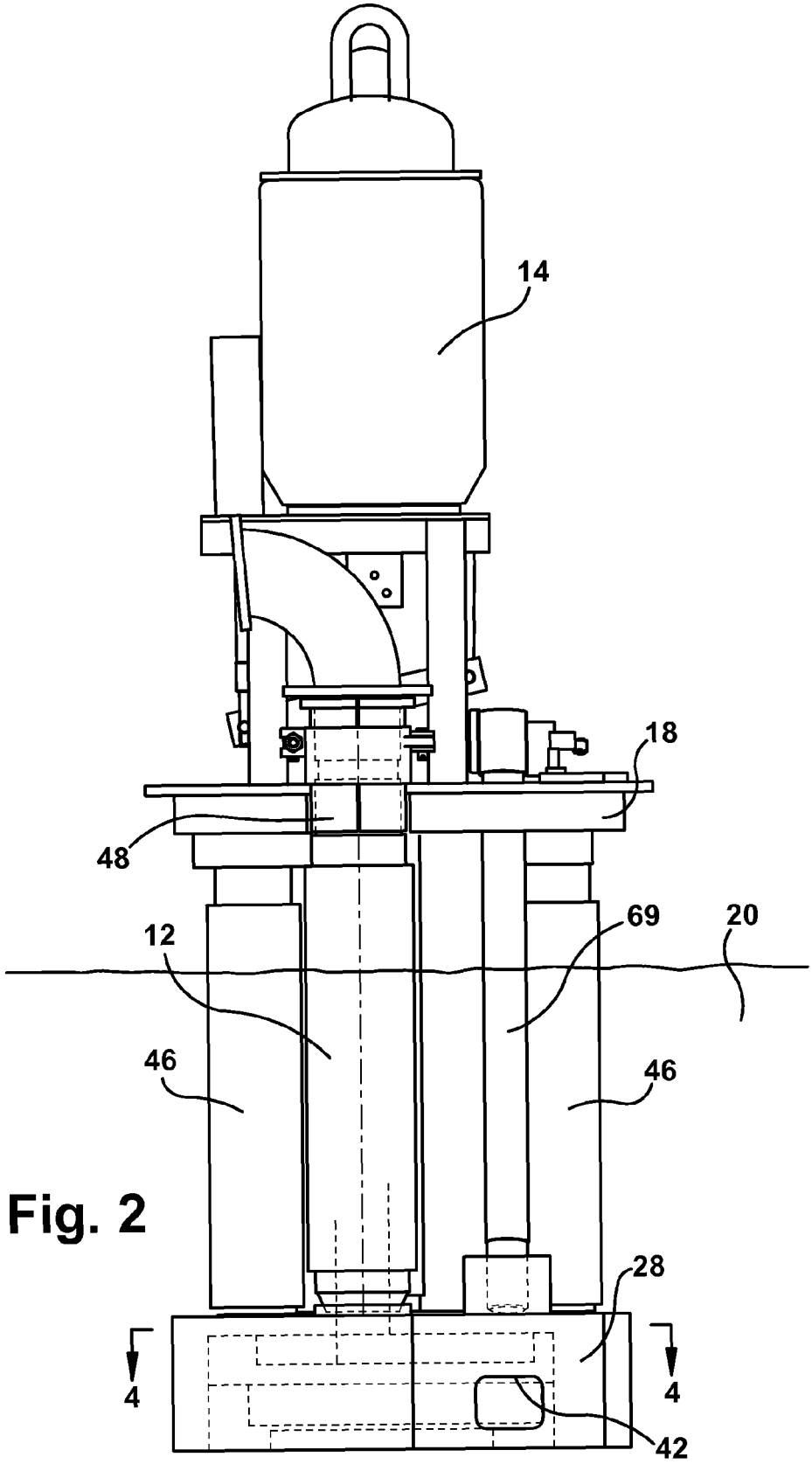
FIG. 2 is a side view of the pump of FIG. 1.
Figure 3:
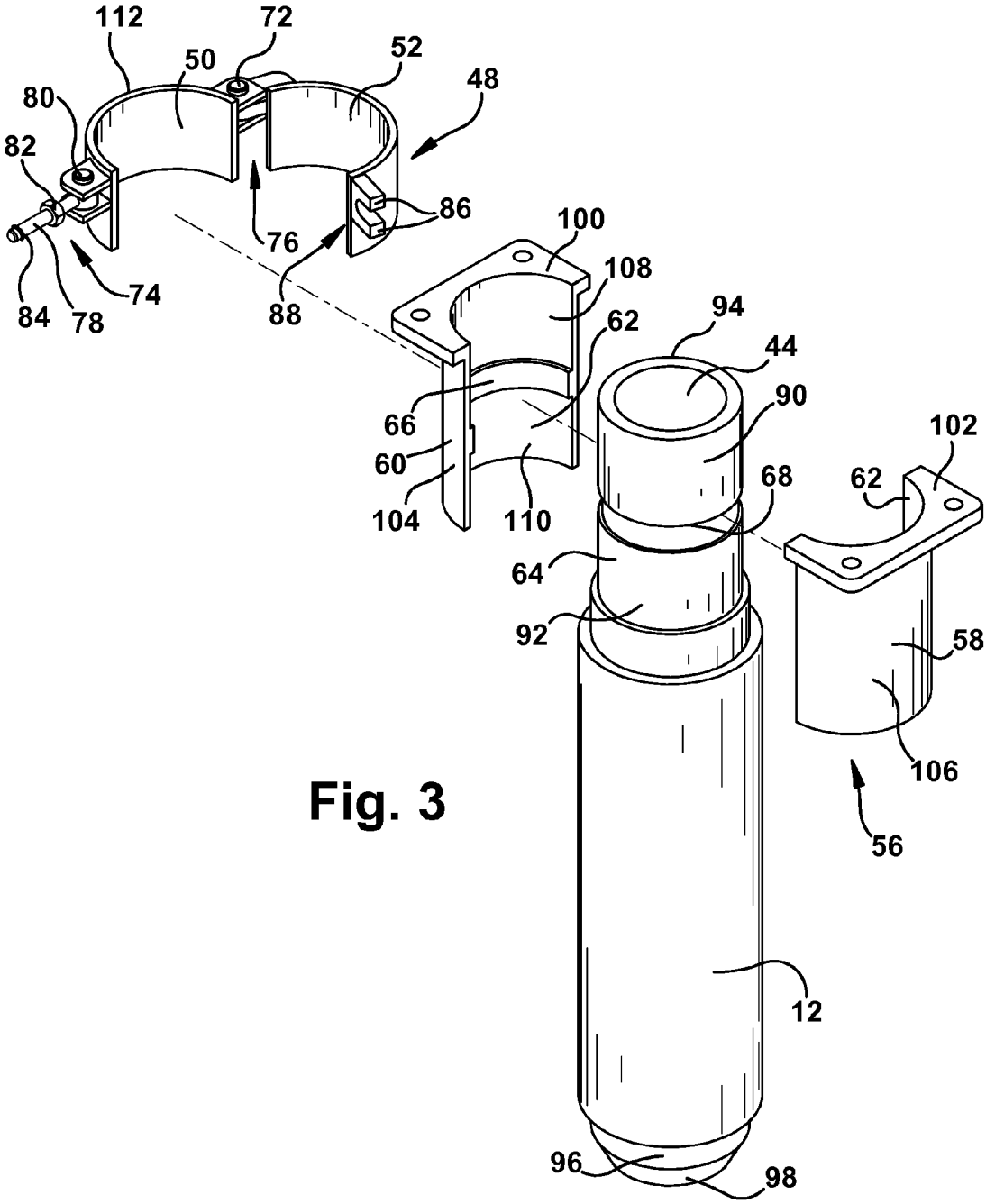
FIG. 3 is an exploded view of the clamp, socket and riser assembly of FIG. 1.
Figure 4:
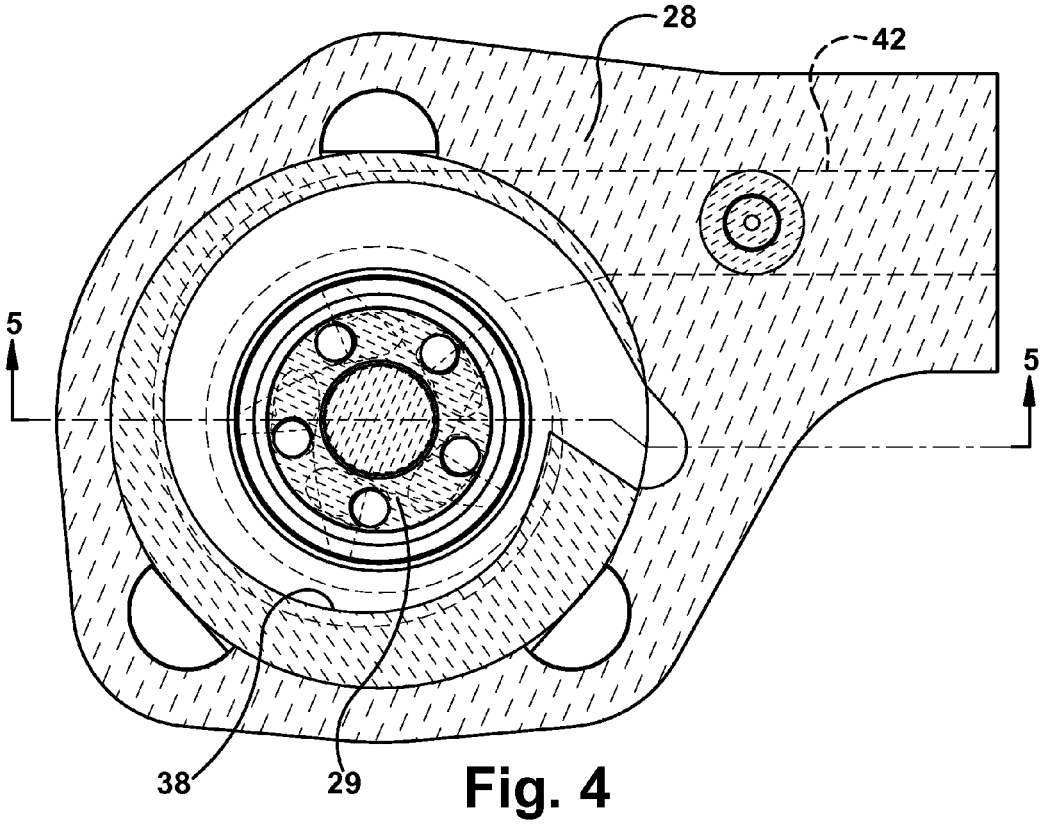
FIG. 4 is a cross-sectional view as seen along the lines and arrows 4-4 of FIG. 2.
Figure 5:
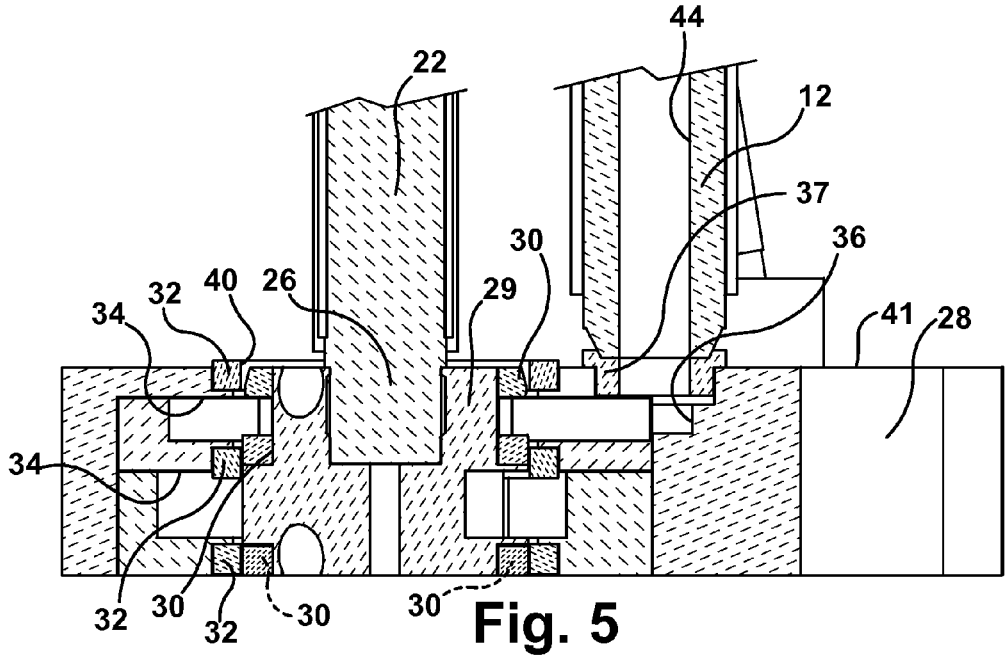
FIG. 5 is a cross-sectional view as seen along the lines and arrows 5-5 of FIG. 4.

Referring to the drawings, a transfer pump 10 for pumping molten metal has a quickly replaceable riser 12. A motor 14 has a drive shaft 16. Support structure referred to as a motor mount 18 a plate is located above a bath of molten metal 20. The motor is disposed on the motor mount. A shaft 22 has a first end 24 coupled to the drive shaft and a second end 26 on which an impeller 29 is connected as with threads or cement. The impeller has bearing rings 30 as known in the art that engage corresponding bearing rings 32 of the base. A base 28 has an impeller chamber 34 in which the impeller is rotatably disposed and a transfer opening 36 in fluid communication with the impeller chamber. The transfer opening leads to exterior surface 41 of the base. A collar 37 may be cemented in the transfer opening to provide a conical mounting surface for the riser. Many impellers are known in the art such as vaned and barrel types of impellers. Suitable impellers are disclosed, for example, in U.S. Pub. No. 2006/0198725, which is incorporated herein by reference in its entirety. The impeller chamber can be formed with or without a volute but is shown with a volute 38 in FIG. 4. An inlet opening 40 leads from the exterior surface 41 of the base into the impeller chamber 34 and an optional discharge passageway 42 leads from the impeller chamber 34 to the exterior surface 41 of the base. A transfer-only pump suitable for use with the clamp assembly of this disclosure would only include a transfer opening and riser without a discharge passageway. The pump shown in the drawings is able to lift the impeller to achieve multiple transfer or discharge functions as described in the 2006/0198725 application. The riser 12 extends from the transfer opening 36 to the motor mount 18. The riser has a central passageway 44 along its length for movement of molten metal. Support posts 46 are cemented to the top of the base and fit into sockets fastened to the motor mount.

A clamp 48 has a first clamp portion 50 mounted to the support structure, such as by welding, and a second clamp portion 52 that is pivotable with respect to the first clamp portion. A fastener 54 is mounted so as to prevent its removal from the clamp for opening and closing the clamp and permitting and preventing movement of the second clamp portion. A split socket 56 has a pair of sections 58, 60 that are disposed above the clamp. Each section of the split socket includes an interior surface 62 that mates with the exterior surface 64 at the top of the riser. For example, the socket sections each have a circumferential projection 66 that engages a circumferential recess 68 at the top of the riser. The pump can include a device including a conduit 69 for flux injection into the molten metal as disclosed in published patent application, U.S. Pub. No. 2008/0236336, which is incorporated herein by reference in its entirety. All of the pump components that contact the molten metal are formed of a refractory material including the impeller, shaft, riser, flux conduit, posts and base.

More specifically, the motor mount has a slot 70. The first clamp portion 50 is fixedly connected to the motor mount in this slot. The second clamp 52 is movable about a pivot 72 relative to the first clamp portion. At the end of the clamp 74 opposite to the end 76 with the pivot is disposed a swing bolt 78. The swing bolt moves about a pivot point 80 in the first clamp portion. A fastener 82 (nut) is located on the swing bolt but has a limited travel due to a spot weld 84 on the bolt. The second clamp portion 52 has projections 86 of a fork 88 that receives the swing bolt. The nut can be tightened in the fork against the projections 86 to firmly close the clamp.

The riser is an elongated tube that has the central passageway 44 throughout its length. The riser has first and second circumferential surfaces 90, 92 on either side of the intermediate circumferential surface or recess 68. An upper end portion 94 of the riser is flat while a lower end portion 96 of the riser has a conical surface 98. The conical lower end portion of the riser is sized to be freely received, without fastening or cement, partway into the opening of the collar 37 so that the conical surfaces of the riser and collar engage each other. The riser remains pressed against the base without fasteners or cement while the pump operates.

The split socket includes two upper flanges 100, 102 and two socket body portions 104, 106 each extending downwardly from one of the flanges. Each of the socket body portions has the interior surface 62. Configured and arranged on this interior surface is an engagement surface that corresponds to the exterior surface of the riser. The engagement surface of the socket body includes first and second circumferential engagement portions 108, 110 and the intermediate projection 66 extending between them. The intermediate projection 66 of each of the socket sections fits into the intermediate recess 68 of the riser. The first and second engagement portions 108, 110 of each socket section contact the first and second engagement surfaces 90, 92 of the riser. This is accomplished by locating the halves of the split socket so that its projections are located relative to the corresponding recess of the riser and then placing the corresponding surfaces in contact with one another.

When the clamp is open the socket is placed inside of it so that the socket flanges are disposed above an upper surface 112 of the clamp. Once the second clamp portion is closed, this applies pressure to the socket halves against the riser, holding the riser tightly in the socket. The swing bolt is then rotated into the fork and the nut is tightened against the protrusions of the fork, securely fastening the riser to the motor mount.

The pump is referred to as a transfer pump as is known in the art because it delivers molten metal along the riser for transfer to another location. However, the pump also has the ability to circulate molten metal as described in published U.S. patent application U.S. Pub. No. 2006/0198725. That is, the pump is a multifunctional pump that combines transfer and circulation/discharge functions. An elbow 114 has a flange 116 which is fastened to the flanges 100, 102 of the split socket. Other piping is connected to another flange 118 of the elbow to direct the molten metal to desired locations.

In normal operation while the motor is running the rotating drive shaft rotates the coupled pump shaft. The impeller that is connected to the pump shaft rotates in the impeller chamber. This causes molten metal to travel through the pump inlet opening into the impeller chamber of the base. If desired, molten metal also travels from the impeller chamber of the base through the discharge passageway along a discharge stream outside the base. Some of the molten metal (or all of the molten metal in a transfer-only functioning pump) leaves the base through the transfer opening. This molten metal is pumped along the riser, the elbow and piping attached to the elbow to a remote location.

Inevitably, at times the riser needs to be replaced. During such times, the nut on the swing bolt 78 is loosened and the swing bolt is swung out of the fork 88. The clamp 48 is opened. The split socket sections 58, 60 are lifted out of the clamp and separated off of the riser so that the socket projections disengage from the riser recess. The riser is lifted off of the base and removed from the pump.

For installing a new riser on the pump, because the clamp and riser are not cemented to the riser the same socket and clamp assembly are reused. The clamp has no small parts that can fall into the molten metal during removal or installation of a riser. The nut 82 on the swing bolt 78 is prevented from being removed from it by the spot weld 84. The socket sections 58 and 60 are positioned around the new riser so that the projections 66 engage the recess 68 of the riser. The flanges 100, 102 of the socket are positioned over the top surface 112 of the clamp. The riser is positioned so that its conical surface 98 rests against the base in alignment with the riser opening of the base (i.e., the opening of the collar 37). The second clamp portion 52 is pivoted closed. The swing bolt 78 is positioned inside the fork and the nut on the swing bolt is tightened against the projections of the fork, which mounts the new riser against the base and securely fastens it to the motor mount.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A transfer pump for pumping molten metal having a riser with a reusable socket comprising;

a motor having a drive shaft;

a support structure located above a bath of molten metal on which said motor is disposed;

a shaft made of refractory material having a first end coupled to said drive shaft and a second end;

an impeller made of refractory material connected to the second end of said shaft;

a base made of refractory material having an impeller chamber in which said impeller is rotatably disposed and a transfer opening;

an inlet opening leading from an exterior surface of said base into said impeller chamber;

a riser made of refractory material extending from said transfer opening to said support structure, said riser having a passageway for molten metal along a length of said riser;

a clamp having a first clamp portion fixedly connected to said support structure and a second clamp portion that is pivotable with respect to said first clamp portion, and a fastener for opening and closing said clamp;

a split socket having a flange and a body portion, wherein said split socket is received in said clamp such that said flange is disposed above said clamp and when said clamp is closed said socket holds said riser.

2. The transfer pump of claim 1 wherein said riser abuts against said base in fluid communication with said transfer opening without being fastened or cemented to said base.

3. The transfer pump of claim 1 wherein said support structure includes a plate on which said motor is mounted and a slot in said plate, said first clamp portion being fixedly fastened to said plate in said slot.

4. The transfer pump of claim 1 wherein said riser includes a projection or a recess in an exterior surface of said riser;

said split socket comprises two or more sections each having said flange and said body portion, each said socket section includes an interior surface having a projection or a recess such that said projection of said riser or said socket corresponds to said recess of said riser or said socket, wherein when said socket is received in said clamp said flanges are positioned above said clamp, and when said clamp is closed said sections of said socket are compressed against said riser such that said projection engages said recess.

5. The transfer pump of claim 4 comprising a pivot at one end of said clamp portions and a fork located at another end of said clamp portions, wherein said fastener includes a swing bolt rotatably fastened to one of said clamp portions and movable into said fork and a nut which is rotatable on said swing bolt against said fork.

6. The transfer pump of claim 5 comprising an obstruction on said swing bolt preventing said nut from being removed from said swing bolt.

* * * * *